US008152985B2

(12) United States Patent
Macary

(10) Patent No.: US 8,152,985 B2
(45) Date of Patent: Apr. 10, 2012

(54) METHOD OF CHROME PLATING MAGNESIUM AND MAGNESIUM ALLOYS

(75) Inventor: Richard Lee Macary, Wheaton, IL (US)

(73) Assignee: Arlington Plating Company, Palatine, IL (US)

( * ) Notice: Subject to any disclaimer, the term of this patent is extended or adjusted under 35 U.S.C. 154(b) by 694 days.

(21) Appl. No.: 12/141,998

(22) Filed: Jun. 19, 2008

(65) Prior Publication Data

US 2009/0317556 A1 Dec. 24, 2009

(51) Int. Cl.

| | |
|---|---|
| ***C25D 5/12*** | (2006.01) |
| ***C25D 5/14*** | (2006.01) |
| ***C25D 5/34*** | (2006.01) |
| ***C23C 28/02*** | (2006.01) |

(52) U.S. Cl. ..... 205/180; 205/178; 205/187; 205/205

(58) Field of Classification Search ..... 205/178, 205/180, 187, 205

See application file for complete search history.

(56) References Cited

U.S. PATENT DOCUMENTS 3,591,350 A * 7/1971 Stareck et al. ..... 428/601
5,879,532 A * 3/1999 Foster et al. ..... 205/192

OTHER PUBLICATIONS

Gray et al., "Protective Coatings on Magnesium and Its Alloys—A Critical Review," Journal of Alloys and Compounds (no month, 2002), vol. 336, pp. 88-113.*

Gu et al., "Electroless Ni-P Plating on AZ91D Magnesium Alloy From A Sulfate Solution," Journal of Alloys and Compounds (no month, 2005), vol. 391, pp. 104-109.*

Oberkoxholt, "Chromium Plating of Zinc Die Castings", Gepgyartastechnologia (no month, 1973), vol. 13, No. 11, pp. 489-493. 1-page Abstract Only.*

Snyder, "Copper Plating," ® no month, 2008, pp. 1-8.*

"Electroplating," (http://en.wikipedia.org/wiki/Electroplating), last accessed Feb. 13, 2008.

"Electroless Nickel Plating," (http://en.wikipedia.org/wiki/Electroless_nickel_plating), last accessed Feb. 11, 2008.

NMFRC Historical Article, Apr. 1952 issue of *Plating*, "Tentative Recommended Practice for Preparation and Plating on Aluminum Alloys," (http://www.nmfrc.org/subs/history/Apr52a.cfm), last accessed Feb. 13, 2008.

Graves, Beverly A., Editor, "Nickel Plating Primer: the basics on nickel plating . . . ", (http://www.pfonline.com/articles/040102.html), last accessed Feb. 11, 2008.

Snyder, Dr. Donald L, "Copper Plating," (http://www.pfonline.com/articies/pdf0014.html), last accessed Feb. 13, 2008.

Ambat, Rajan and Zhou, W., "Electroless Nickel-Plating on AZ91D Magnesium Alloy: Effect of Substrate Microstructure and Plating Parameters," (http://www.sciencedirect.com, Surface and Coatings Technology 179 (2004), pp. 124-134).

DeLong, H.K., "Plating on Magnesium by Electrodeposition and Chemical Reduction Methods," article, 10 pages.

"Electroplating Magnesium," article, pp. 43-54.

"Corrosion Mechanism," slide presentation, Arlington Plating Company, Dec. 10, 2003, p. 52.

"Corrosion Mechanism," slide presentation, Arlington Plating Company, Dec. 10, 2003, p. 54.

* cited by examiner

*Primary Examiner* — Edna Wong
(74) *Attorney, Agent, or Firm* — J.M. Robertson, LLC

(57) ABSTRACT

A process for chrome plating magnesium and its alloys. The process uses a combination of electroless nickel plating, a multi-stage copper coating transition system and multiple layers of electrodeposited nickel to form a corrosion resistant system of substantial impermeability and interlayer adherence suitable for direct chromium electroplating.

8 Claims, 3 Drawing Sheets

METHOD OF CHROME PLATING MAGNESIUM AND MAGNESIUM ALLOYS

TECHNICAL FIELD

The present invention relates generally to chrome plating and, more particularly, to the chrome plating of magnesium and magnesium alloy parts using combinations of surface treatments and intermediate coating operations to provide an adherent multi-layered coating providing substantial corrosion resistance.

BACKGROUND OF THE INVENTION

Magnesium and its alloys are characterized by an extremely low density and high strength to weight ratio relative to other structural materials such as steel and aluminum. Thus, magnesium and its alloys have gained increasing acceptance as the structural material of choice for use in industries such as aerospace, automotive, electronics and the like. In its pure state, magnesium is highly reactive. Thus, for most commercial applications, magnesium is alloyed with compatible elements such as aluminum, copper and the like. Alloys of magnesium and aluminum have gained particularly broad acceptance.

Alloys of magnesium may have a relatively high susceptibility to corrosion. This may be particularly true when the alloys are exposed to environments having high salt concentrations such as may exist near seawater. To address this susceptibility to corrosion, it may be desirable to provide coatings across a magnesium alloy part in an attempt to seal the surface from the corrosive environment. One such technique which has been used is electroless nickel coating. While electroless nickel coating provides a hard covering providing a degree of corrosion resistance, the corrosion protection is highly dependent upon the coating porosity. In this regard, due to the highly cathodic nature of the electroless nickel relative to the underlying magnesium alloy substrate, a crack or other flaw in the electroless nickel coating may cause corrosion to be preferentially concentrated at that location. Aside from this deficiency in the corrosion protection mechanism of the electroless nickel coating, it has also been found that such electroless nickel does not provide a suitably stable base for the direct over coating by chromium as may be desired for aesthetic purposes.

It is known to use electroplating to apply protective coatings across a substrate part of aluminum. The ability of an electroplated coating to protect an underlying metal substrate is dependent upon a number of factors. These factors include the position of the metal coating material in the galvanic series, the adhesion between the coating and the underlying layer and the porosity of the coating layer. In order to maintain long-term corrosion resistance, it is generally desirable to promote uniformity of the over-coated layers across the plated part. Such uniformity permits the naturally occurring oxidation and reduction reactions to take place across the entire surface thereby avoiding the possibility of localized corrosive attack.

One commercial electroplating system uses electroplating to apply layers of semi-bright nickel, bright nickel and/or micro-porous nickel across copper coated aluminum parts to provide a multi-layered corrosion resistant system for an aluminum part. The applied coating layers also provide a stable base for adherent over coating by chromium. However, it is not believed that such systems have been used successfully with magnesium or its alloys. In this regard, it is not believed that the layered arrangements used previously with aluminum are suitable to provide the necessary combination of adherence and corrosion resistance if applied to magnesium. Thus, there exists a need for a system for coating magnesium and its alloys which provides both corrosion resistance and a stable base for chrome over plating.

SUMMARY OF THE INVENTION

The present invention provides advantages and alternatives over the prior art by providing a process for chrome plating magnesium and magnesium alloys. The process uses a combination of electroless nickel plating, a multi-stage copper coating transition zone and multiple layers of electrodeposited nickel to form a corrosion resistant system of substantial impermeability and interlayer adherence and which is suitable for direct chromium over plating.

It is to be understood that other aspects, advantages, and features will become apparent through reading of the following detailed description of preferred embodiments and practices and/or through practice of the invention by those of skill in the art. Accordingly, the detailed description is to be understood as being exemplary and explanatory only and in no event is the invention to be limited to any illustrated and described embodiments. On the contrary, it is intended that the present invention shall extend to all alternatives and modifications as may embrace the principles of this invention within the true spirit and scope thereof.

BRIEF DESCRIPTION OF THE DRAWINGS

The present invention will now be described by way of example only, with reference to the accompanying drawings which are incorporated in and which constitute a part of the specification herein, and together with the general description given above, and the detailed description set forth below, serve to explain the principles of the invention wherein.

While the invention has been generally described above and will hereinafter be described in connection with certain potentially preferred embodiments and procedures, it is to be understood that in no event is the invention to be limited to such illustrated and described embodiments and procedures. On the contrary, it is intended that the present invention shall extend to all alternatives and modifications to the illustrated and described embodiments and procedures as may embrace the broad principles of this invention within the true spirit and scope thereof.

DESCRIPTION OF PREFERRED EMBODIMENTS

Figure 1:
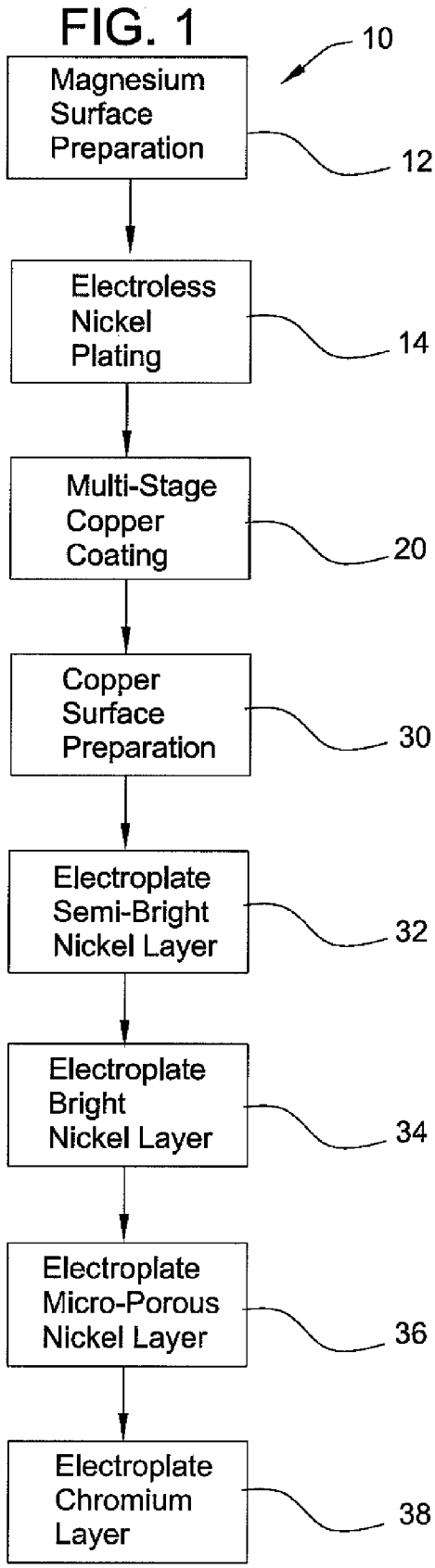
FIG. 1 is a flow chart setting forth steps for an exemplary process for chrome plating a magnesium or magnesium alloy part.

Reference will now be made to the various figures. Throughout this disclosure all references to magnesium shall be understood to encompass magnesium as well as alloys containing a predominant percentage of magnesium. FIG. 1 is a flow diagram setting forth exemplary steps in a process 10 for chrome plating a magnesium part. As shown, the exemplary process is initiated by magnesium surface preparation 12 during which the surface undergoes various treatments to yield a surface character suitable for subsequent coating operations as will be described further hereinafter. According to one exemplary practice, the magnesium surface preparation includes polishing and buffing the magnesium surface to a smooth finish. Thereafter, any grease, buffing compounds or other similar oily matter may be is removed by a suitable technique such as solvent rinsing, vapor degreasing using trichloroethylene or other suitable chlorinated solvents, solvent emulsion cleaning or the like. The degreased part is then soaked in an alkaline cleaner containing caustic soda as will be well known to those of skill in the art. Following alkaline cleaning, the part is treated in an aqueous bath containing an acidic etchant such as chromic acid, bichromate and nitric acid or the like. The chemically etched part is thereafter immersed in a bath containing an alkali metal fluoride or hydrofluoric acid in sufficient concentrations to develop a surface layer of magnesium fluoride. As will be appreciated by those of skill in the art, these surface preparation procedures are susceptible to a wide array of alternatives. Thus, it is contemplated that any number of other procedures and practices may likewise be utilized to perform the functions of cleaning and magnesium fluoride development if desired.

As shown, once the magnesium part has undergone surface preparation, it is thereafter subjected to an electroless nickel plating process 14. As will be recognized by those of skill in the art, electroless nickel plating is a technique used to apply a layer of nickel-phosphorous alloy across a work piece. It is contemplated that any of the standard commercially available electroless nickel baths may be utilized. The deposited layer is preferably formed at a thickness of about 0.0006 to about 0.0008 inches although greater or lesser thicknesses may be utilized if desired.

Figure 2:
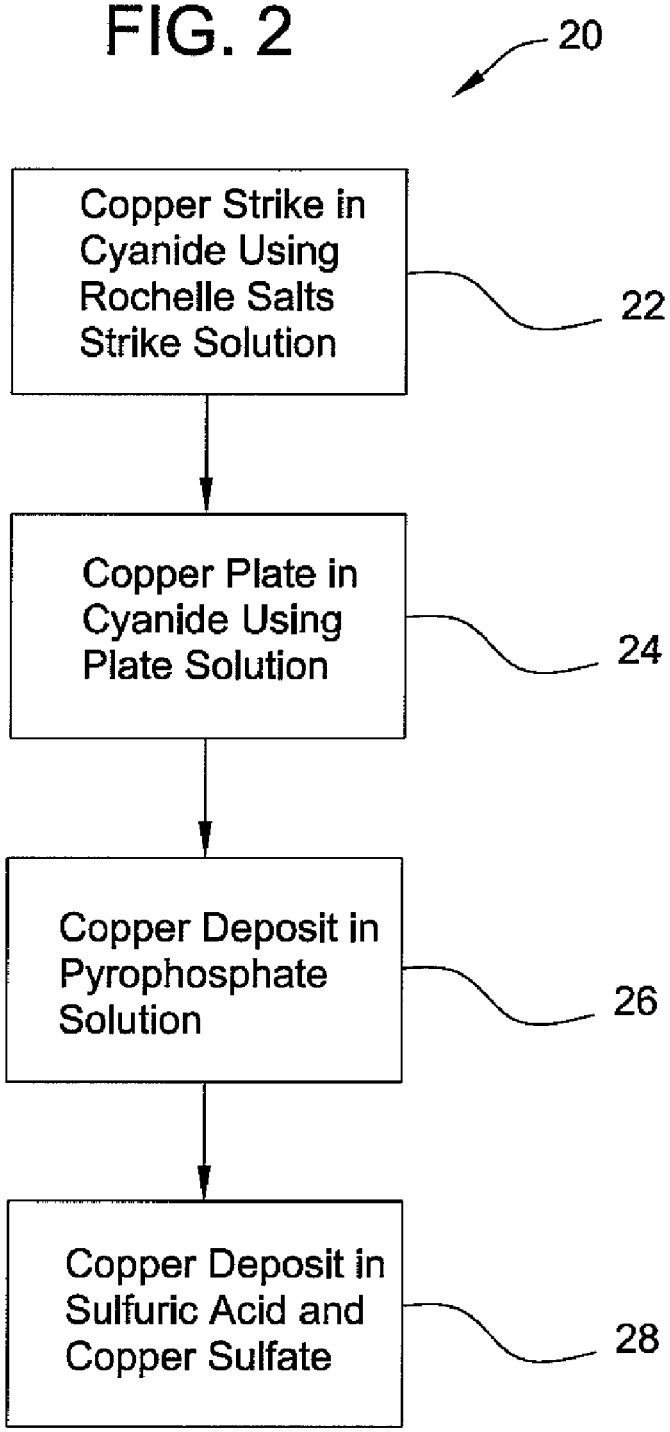
FIG. 2 is a flow chart setting forth steps for an exemplary process for developing a multi-stage copper transition zone.

According to the illustrated practice, following electroless nickel plating 14, the work piece is thereafter subjected to a multi-stage copper coating process 20 as set forth more completely in FIG. 2. The exemplary process incorporates a four stage copper coating system using electrodeposition at each stage. The first stage of the exemplary multi-stage copper coating process 20 is preferably a preliminary copper strike 22 using a Rochelle salt copper strike solution. By way of example only and not limitation, one exemplary copper strike solution has a makeup of about 5.5 ounces per gallon copper cyanide, about 6.5 ounces per gallon total sodium cyanide, about 4 ounces per gallon sodium carbonate, about 8 ounces per gallon Rochelle salts and up to about 0.5 ounces per gallon free sodium cyanide. The copper strike is carried out at a temperature of about 100 to about 130 degrees Fahrenheit using a current density of about 2.5 amperes per square foot for about 5 minutes to get an initial rapid covering. At the conclusion of the copper strike 22, the applied copper preferably has a thickness of about 0.0001 to about 0.0002 inches.

The second stage of the exemplary multi-stage copper coating process 20 is a copper plating step 24 carried out at a temperature of about 100 to about 130 degrees Fahrenheit using a current density of about 5 amperes per square foot for about 10 minutes. By way of example only, one exemplary plating bath used in the copper plating step 24 is a cyanide bath having a composition as described above in relation to the copper strike 22. Due to the current density levels and extended treatment times any propensity to develop surface irregularities is substantially reduced. The copper plating step applies an additional copper thickness of about 0.0001 to about 0.0002 inches.

The third stage of the exemplary multi-stage copper coating process 20 is preferably a pyrophosphate copper deposit step 26 carried out in a mildly alkaline pyrophosphate bath having a pH of about 8 to about 9. By way of example only, one exemplary bath has a make-up of about 6 ounces per gallon pyrophosphate, about 4 ounces per gallon copper, and about 1.5 ounces per gallon ammonium. The pyrophosphate copper deposit step 24 is carried out for about 20 minutes at a temperature of about 130 to about 140 degrees Fahrenheit using an anode current density of about 20 amperes per square foot and a cathode current density of about 40 amperes per square foot. The pyrophosphate copper deposit step 26 preferably adds an additional copper thickness of about 0.0002 to about 0.0003 inches.

The fourth stage of the exemplary multi-stage copper coating process 20 is preferably an acid copper deposit step 28 carried out in an acid bath containing sulfuric acid and copper sulfate. By way of example only, one suitable acid bath incorporates about 4 ounces per gallon copper sulfate, about 0.1 ounces per gallon sulfuric acid, and about 0.1 ounces per gallon hydrochloric acid. The copper deposit step 28 is preferably carried out for about 60 minutes at a temperature of about 75 to about 85 degrees Fahrenheit using bagged phosphorized copper anodes with an anode current density of about 20 amperes per square foot and a cathode current density of about 40 amperes per square foot. The acid copper deposit step 28 preferably adds a relatively thick final copper layer having a thickness of about 0.001 to about 0.002 inches.

At the conclusion of the multi-stage copper coating process 20, a substantially impermeable and highly adherent copper layer is present. In accordance with a potentially preferred practice, the copper coated substrate is thereafter subjected to a copper surface preparation procedure 30 to provide a cleaned surface adapted for subsequent nickel plating as will be described further hereinafter. In accordance with one exemplary practice, the copper surface preparation procedure 30 incorporates a buffing operation to develop a smooth finish across the copper plated magnesium. Thereafter, any grease, buffing compounds or other similar oily matter may be is removed by a suitable technique such as solvent rinsing, vapor degreasing using trichloroethylene or other suitable chlorinated solvents, solvent emulsion cleaning or the like. The degreased part is then soaked clean in an alkaline cleaner containing caustic soda. According to a potentially preferred practice, the cleaned part is then immersed in an activation bath including sulfuric acid and hydrogen peroxide.

The copper coated part with cleaned and activated copper surfaces may thereafter be submitted to a series of nickel electroplating operations to develop an adherent and corrosion resistant covering. Specifically, the copper coated part may be subjected to a semi-bright nickel electroplating step 32 followed sequentially by a bright nickel electroplating step 34 and an optional micro-porous nickel electroplating step 36. The structure with electroplated nickel layers may thereafter be subjected to a chromium electroplating step 38 to develop an aesthetic show surface.

Figure 3:
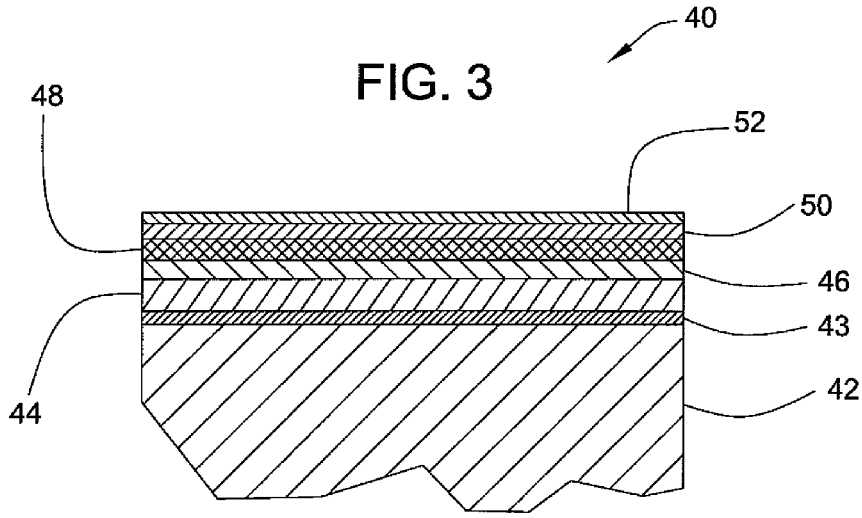
FIG. 3 is a schematic view illustrating an exemplary arrangement of coating layers across a substrate.

The development of nickel and chromium layers will now be described through joint reference to FIGS. 1 and 3. In this regard, it is to be understood that FIG. 3 is not to scale. Rather, it is presented merely as an aid to understanding the relative positional relationship of various layers in the illustrated exemplary construction. In the exemplary construction, a base 42 of magnesium or magnesium alloy is provided with a nickel-phosphorous layer 43 provided by an electroless nickel plating process 14. A copper coating 44 applied using a multi-stage copper coating process 20 as previously described in relation to FIG. 2 is present across the nickel-phosphorous layer 43. The copper coating is thereafter electroplated with a layer of semi-bright nickel 46 followed by a layer of bright nickel 48. By way of example only, and not limitation, in accordance with one contemplated practice the layer of semi-bright nickel 46 may have a thickness of about 0.0006 inches with the bright nickel 48 having a thickness of about 0.0004 inches. However, it is contemplated that these levels may be readily adjusted as desired. The nickel plating operations may be carried out in a traditional Watts nickel plating bath incorporating nickel sulfate $NiSO_4$ in combination with nickel chloride $NiCl_2$ and boric acid at a pH of about 3.85 and a current density of about 20 ampers per square foot using bagged nickel anodes. However, other suitable plating techniques may likewise be utilized if desired.

As will be appreciated, the semi-bright nickel 46 is preferably substantially sulfur-free and is characterized by a substantially columnar structure while the bright nickel 48 is preferably substantially lamellar in structure. The semi-bright nickel 46 will preferably be slightly cathodic (i.e. more noble) than the bright nickel 48. The potential difference between the semi-bright nickel 46 and the bright nickel 48 is preferably in the range of about 110 millivolts to about 200 millivolts.

Following application of the bright nickel 48, a relatively thin layer of high activity micro-porous nickel 50 may be applied across the entire surface. The micro-porous nickel 50 is preferably anodic relative to the underlying layer of bright nickel 48. By way of example only, the potential difference between the micro-porous nickel 50 and the bright nickel 48 will preferably be not less than about 15 millivolts. The layer of micro-porous nickel 50 may have a thickness of about 0.0001 inches, although this level may be adjusted as desired. The micro-porous structure and anodic character of the micro-porous nickel relative to the underlying bright nickel 26 may serve to distribute oxidation substantially across the entire surface of the structure thereby aiding in the avoidance of concentrated localized degradation. It is to be understood that while the layer of micro-porous nickel 50 may be useful in many applications requiring particularly strong corrosion resistance, it is also contemplated that such a layer may be eliminated if desired while still maintaining substantial corrosion resistance characteristics.

Following application of various nickel layers, a relatively thin layer of chromium 52 may be electroplated across the entire structure. The layer of chromium 52 defines an outer show surface of high reflectivity. By way of example only, and not limitation, the layer of chromium 52 may have a thickness of about 0.0001 to about 0.0002 inches, although this level may be adjusted as desired.

According a potentially preferred practice, after the final plating operation, parts may be submersed in an iso-propyl alcohol solution to displace the water and mitigate any magnesium corrosion coming from exposed magnesium due to plating rack marks or masked areas.

As will be appreciated, the present invention provides a method for developing a substantially corrosion-resistant and adherent chrome plating across a magnesium or magnesium alloy part. A multi-stage copper coating process 20 is used to develop a highly adherent and low porosity copper bridging layer between a surface treated magnesium substrate and over coated nickel layers. Any propensity for corrosion is substantially mitigated by inclusion of a high activity micro-porous nickel layer in underlying relation to a chromium surface layer.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method of chrome plating a magnesium or magnesium alloy part, the method comprising the steps of:

(a) treating the part with a fluoridating agent to develop a fluoridated surface layer including magnesium fluoride;

(b) using electroless nickel plating to apply a nickel-phosphorous alloy layer across at least a portion of the fluoridated surface layer;

(c) applying a copper coating at a position above the nickel-phosphorous alloy layer using a series of copper electrodeposition treatments, wherein said series of copper electrodeposition treatments includes at least one copper electrodeposition treatment using a cyanide solution, at least one copper electrodeposition treatment using a pyrophosphate solution of basic pH and at least one copper electrodeposition treatment using an acid solution;

(d) electrodepositing a semi-bright nickel layer at a position above the copper coating;

(e) electrodepositing a bright nickel layer at a position above the semi-bright nickel;

(f) electrodepositing a layer of micro-porous nickel at a position above the bright nickel; and (g) electrodepositing a chromium layer at a position above the micro-porous nickel.

2. The method as recited in claim 1, wherein the fluoridating agent is selected from the group consisting of alkali metal fluorides, hydrofluoric acid and combinations thereof.

3. The method as recited in claim 1, wherein the nickel-phosphorous alloy layer has a thickness in the range of about 0.0003 to about 0.0004 inches.

4. The method as recited in claim 1, wherein said series of copper electrodeposition treatments further includes a preliminary copper strike electrodeposition treatment using a Rochelle salt solution.

5. The method as recited in claim 1, wherein the semi-bright nickel layer has a thickness of about 0.0006 inches, the bright nickel layer has a thickness of about 0.0004 inches, and the micro-porous nickel layer has a thickness of about 0.0001 inches.

6. The method as recited in claim 1, wherein the chromium layer has a thickness of about 0.0001 to about 0.0002 inches.

7. A method of chrome plating a magnesium or magnesium alloy part, the method comprising the steps of:

(a) treating the part with a fluoridating agent to develop a fluoridated surface layer including magnesium fluoride;

(b) using electroless nickel plating to apply a nickel-phosphorous alloy layer across at least a portion of the fluoridated surface layer;

(c) applying a copper coating at a position above the nickel-phosphorous alloy layer using a series of copper electrodeposition treatments, wherein said series of copper electrodeposition treatments includes a preliminary copper strike electrodeposition treatment using a Rochelle salt solution, at least one copper electrodeposition treatment using a cyanide solution, at least one copper electrodeposition treatment using a pyrophosphate solution of basic pH and at least one copper electrodeposition treatment using an acid solution;

(d) electrodepositing a semi-bright nickel layer at a position above the copper coating;

(e) electrodepositing a bright nickel layer at a position above the semi-bright nickel;

(f) electrodepositing a layer of micro-porous nickel at a position above the bright nickel: and (g) electrodepositing a chromium layer at a position above the micro-porous nickel, wherein said preliminary copper strike electrodeposition treatment using a Rochelle salt solution, said at least one copper electrodeposition treatment using a cyanide solution, said at least one copper electrodeposition treatment using a pyrophosphate solution of basic pH and said at least one copper electrodeposition treatment using an acid solution are carried out sequentially.

8. The method as recited in claim 7, wherein said preliminary copper strike electrodeposition treatment using a Rochelle salt solution applies a copper thickness in the range of about 0.0001 to about 0.0002 inches, said at least one copper electrodeposition treatment using a cyanide solution applies a copper thickness in the range of about 0.0001 to about 0.0002 inches, said at least one copper electrodeposition treatment using a pyrophosphate solution of basic pH applies a copper thickness in the range of about 0.0002 to about 0.0003 inches, and said at least one copper electrodeposition treatment using an acid solution applies a copper thickness in the range of about 0.001 to about 0.002 inches.

* * * * *